US006575735B1

(12) United States Patent
Lloveras Capilla

(10) Patent No.: US 6,575,735 B1
(45) Date of Patent: Jun. 10, 2003

(54) PORTABLE LIGHTER

(75) Inventor: Xavier Lloveras Capilla, Barcelona (ES)

(73) Assignee: Flamagas, S.A. (ES)

( * ) Notice: Subject to any disclaimer, the term of this patent is extended or adjusted under 35 U.S.C. 154(b) by 0 days.

(21) Appl. No.: 10/048,860

(22) PCT Filed: Aug. 1, 2000

(86) PCT No.: PCT/ES00/00296

§ 371 (c)(1),
(2), (4) Date: May 28, 2002

(87) PCT Pub. No.: WO01/09551

PCT Pub. Date: Feb. 8, 2001

(30) Foreign Application Priority Data

Aug. 2, 1999 (ES) ..... 9901754

(51) Int. Cl.[7] ..... F23D 11/36; F23Q 7/12
(52) U.S. Cl. ..... 431/153; 431/255
(58) Field of Search ..... 431/255, 153

(56) References Cited

U.S. PATENT DOCUMENTS

| | | | | |
|---|---|---|---|---|
| 5,002,482 A | | 3/1991 | Fairbanks et al. | |
| 5,090,893 A | | 2/1992 | Floriot | |
| 5,462,432 A | * | 10/1995 | Kim | 431/153 |
| 5,490,773 A | | 2/1996 | Capilla | |
| 5,997,282 A | * | 12/1999 | Man | 431/153 |
| 6,095,796 A | | 8/2000 | Sung | |

FOREIGN PATENT DOCUMENTS

| | | | |
|---|---|---|---|
| EP | 0345729 | | 12/1989 |
| EP | 0488158 | | 6/1992 |
| FR | 2650876 | | 2/1991 |
| GB | 2034449 | | 6/1980 |
| WO | WO 9208931 | * | 5/1992 |
| WO | 9911973 | | 3/1999 |
| WO | 9946539 | | 9/1999 |
| WO | 0022349 | | 4/2000 |

OTHER PUBLICATIONS

International Search Report mailed Nov. 8, 2000, for PCT/ES 00/00296.

* cited by examiner

*Primary Examiner*—Henry Bennett
*Assistant Examiner*—Alfred Basichas
(74) *Attorney, Agent, or Firm*—Ostrolenk, Faber, Gerb & Soffen LLP

(57) ABSTRACT

A portable lighter suitable for reaching a state of ignition. The lighter having a lighting mechanism activatable by a single movement of an operator's finger, which finger has a resistance to deformation. The lighting mechanism includes a first actuator movable between a first position and a second position, and a second actuator movable between a third position and a fourth position. The second position and the fourth position define a relative position between the first actuator and the second actuator. The actuators are arranged so that when the first actuator is moved by the single finger movement from the first position to the second position the finger also moves the second actuator from the third position to the fourth position. The relative position is variable according to the fingers resistance to deformation and the lighter reaches the state of ignition only for certain preset values of the relative position.

9 Claims, 7 Drawing Sheets

Figure 1:
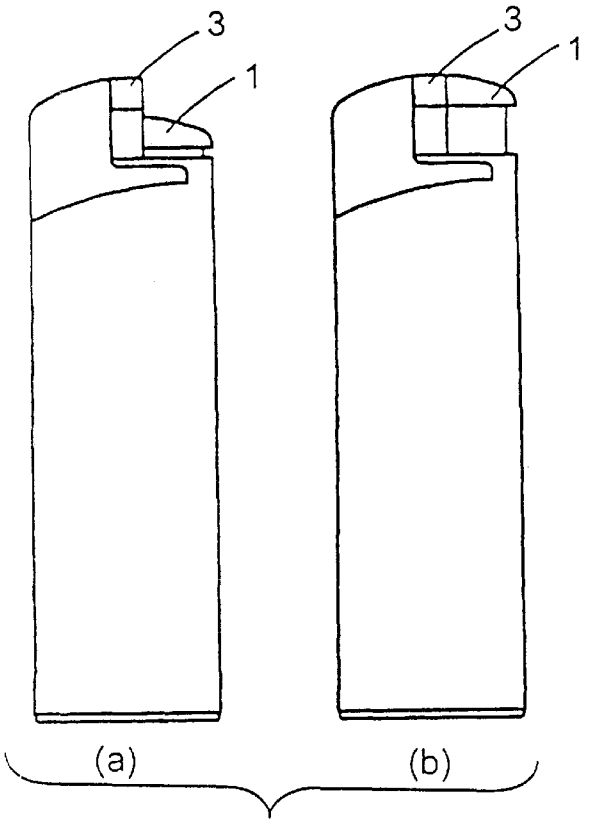

FIG. 5
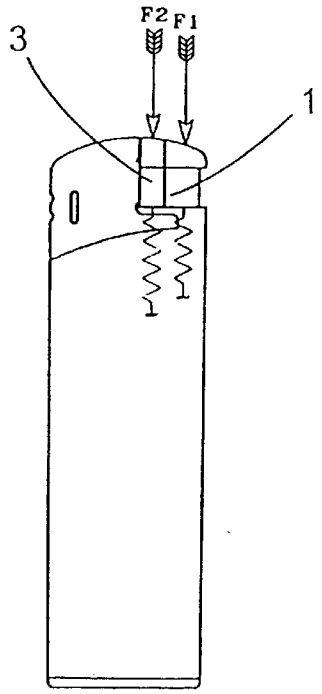
FIG. 6
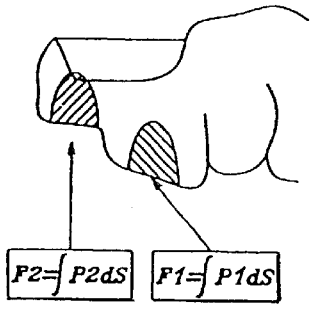
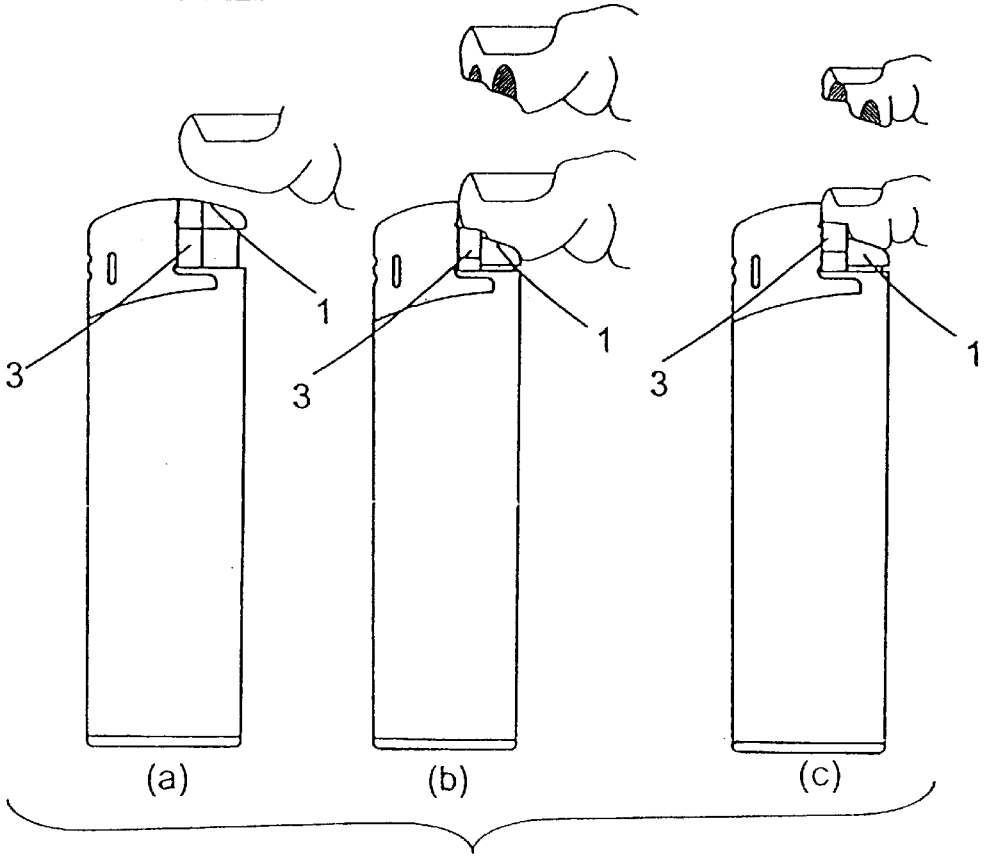
FIG. 7

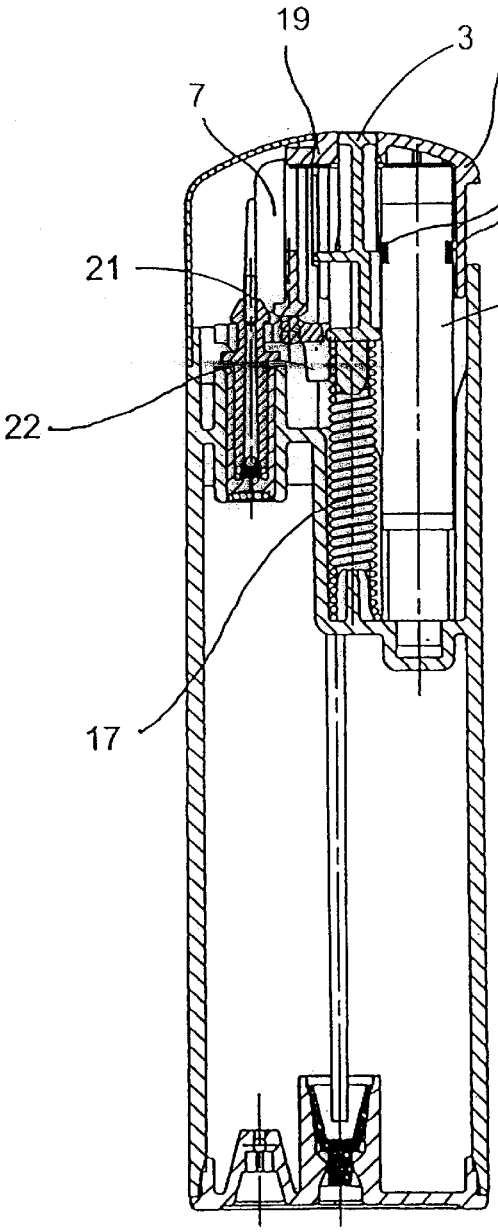
FIG. 9
FIG. 12
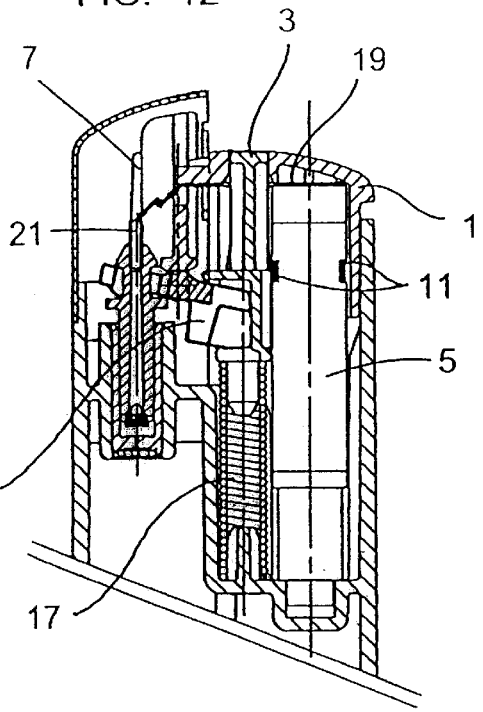
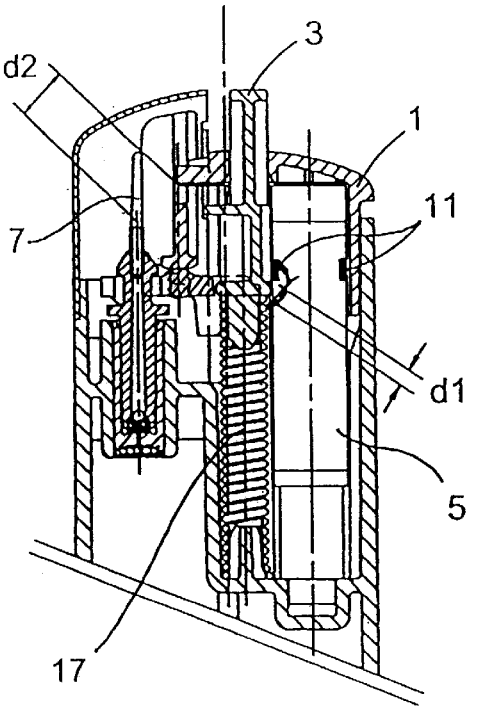
FIG. 13

PORTABLE LIGHTER

DESCRIPTION

The invention refers to a portable lighter of the type that is apt for reaching a state of ignition and having a lighting mechanism adequate to be activated by means of one single finger movement, with said finger presenting a resistance to deformation. The mechanism consists of at least a first actuator and a second actuator, this first actuator being apt to move between a first position and a second position, and the second actuator being apt for moving between a third position and a fourth position, where the second position and the fourth position define a relative position between the first actuator and the second actuator.

In recent years the use of lighters has become extraordinarily popular, no longer being luxury items or of personal use, and therefore submitted to a direct control on the part of the user, becoming abundantly available objects, that may be found indiscriminately in any place of a house, vehicle or facility. Likewise, as they are devices designed to produce a flame, awareness has increased of the implicit danger of their use by children, especially when these are away from adult supervision. Thus, different models of lighters with safety mechanisms have appeared on the market with the object of increasing the degree of protection in this sense.

The first solutions available for the technical challenge involved in making the lighting more difficult for children, without excessively complicating the use for adults, consisted of placing retractable elements under the button of the gas valve, impeding its activation course unless previous to the intention of lighting they were moved from their normal inhibiting position to another in which they would not be an obstacle to the movement of the former. Clearly representing this period of time are inventions such as those described in the registrations U.S. Pat. No. 5,002,482 or U.S. Pat. No. 5,090,893 in the case of wheel and pyrophoric stone lighters, or EP 488,158 in the case of piezoelectric lighters.

The additional safety that these models provide is based on adding to a conventional ignition movement or action another previous action consisting in moving a retractable element to a non-inhibiting position. Lighters with a safety mechanism that follow this principle are known as "dual-action" lighters. Regrettably, in the case of pocket lighters, due to their small size, these retractable elements must be tiny, and while it is true that they provide additional safety, they undeniably possess a difficulty of operation for adults also which in some cases can become insuperable, especially for those who are less capable with their handling abilities. Furthermore, since they are based on the correct performance of visible actions, they are easily imitated by children, which reduces the efficacy of the protection.

The appearance of "single action" lighters provided an interesting solution to the problems mentioned in the previous paragraph. They are not based on the accumulation of actions as a consequence of adding complementary mechanisms, but rather in taking advantage, based on a correct positioning of the conventional igniting elements, of the ergonomic differences between children and adults.

A first generation of "single action" lighters is well represented in registration U.S. Pat. No. 5,490,773. This requires performing movements on the conventional igniting elements that are difficult for children to perform, due to the geometric characteristics of their fingers. Furthermore, due to the scarce extent of these movements they are not visible, and thus they cannot be learned by imitation.

The object of this Patent application is a second generation of "single action" lighters, that is, lighters that can be lit by means of one single movement. It is based on the difference of hardness of a child's fingertip and that of an adult, understanding hardness to be the resistance that a surface provides to the penetration or the deformation of an object. At higher penetration or higher deformation under the same contact force, it is understood that the surface is less hard.

The reason of this lower hardness of a child's fingertip with respect to an adult's is a consequence of the different cell characteristics and the thickness of the skin, the underlying tissue and especially the smaller size of the internal bones (phalanxes), which confer consistence to them. The invention object of this application will take advantage of this universal ergonomic difference.

The invention described in this Patent application uses this relative difference in hardness, in cooperation with an adequate design of the constituting elements of the lighting mechanism, to enable or impede reaching a state of ignition.

This purpose is attained by means of a portable lighter of the type mentioned at the beginning, characterized in that when moving by means of a finger the first actuator from the first position to the second position, said finger moves the second actuator from the third position to the fourth position, where the relative position between both actuators in said second and fourth position is variable depending on the resistance to the deformation of the finger, and in that said portable lighter reaches the state of ignition only for certain preset values of said relative position.

Thus, in the case of each specific lighter it is possible to calculate or measure the relative positions that are reached when the lighter is being handled by an adult and the relative positions that are reached when the lighter is being handled by a child, and from this data the internal mechanisms of the lighter can be developed and adjusted. It must also be taken into account that it is possible to influence over the values of these relative positions in various ways, by varying the geometries of movement, the support surfaces, the spring characteristics, etc.

A preferred embodiment is obtained by making the fourth position variable depending on the mentioned resistance to deformation with the second position being substantially independent from said resistance to deformation, and therefore the mentioned relative position is made variable depending on said fourth position. It must be understood in this case that small possible differences in said second position due to construction matters not related to the object of this invention must not be considered as conceptually different second positions from the viewpoint of the invention.

In the case of lighters of the type that have an energy generator apt for liberating an ignition energy and that require that said ignition energy arrives to an ignition zone to reach said state of ignition, a preferred type of embodiment of the invention is obtained when the first actuator acts upon the energy generator, which liberates the ignition energy and when the second actuator, in said certain preset values of said relative position, allows the ignition energy to get to said ignition area.

Preferably said ignition energy is apt to cause the ignition of a combustible fluid, as is usual in the majority of lighters which incorporate a canister with combustible fluid and in which the state of ignition is characterized by a flame. However, other types of lighters should not be dismissed, in which, for example, an electric resistor is heated to incandescence and it is directly used for lighting, for example, a cigarette, by direct contact of the cigarette with the incandescent resistor or simply by proximity of the cigarette to the incandescent resistor.

The object of the invention can be applied to a multitude of practical embodiments, such as:

that said energy generator is a pyrophoric stone, and that said ignition energy is a spark, in which case, preferably, the second actuator inserts a shield between said spark and said ignition zone when said relative position is any other than one of said preset values.

that said energy generator is an electric battery, and that said ignition energy is an electric current that heats an electric resistor, in which case, preferably, the second actuator diverts or, alternatively, inhibits said electric current avoiding that this electric resistor heats up when said relative position is any other than one of said preset values.

that said energy generator is a piezoelectric mechanism, and that said ignition energy is a spark, in which case, preferably, the second actuator diverts said spark from the piezoelectric element to an inert area away from the ignition zone when said relative position is any other than one of said preset values.

that said energy generator is an electric battery and that said ignition energy is an electric current which generates a spark, in which case, preferably, the second actuator diverts said electric current avoiding that the spark is formed when said relative position is any other than said preset values. These lighters usually include, additionally, a circuit apt to increase the electric voltage in the battery terminals to certain values apt for generating a spark. However, said circuit does not have any influence on the object of the invention, so it is not taken into account in what follows.

Another preferred embodiment of the invention in lighters that have an energy generator apt to liberate an ignition energy to reach said ignition state, is obtained by making the second actuator act on said energy generator, which only liberates the ignition energy when said second actuator reaches said certain preset values of said relative position. In this case the ignition energy is not impeded from getting to the ignition area, but rather the formation of said ignition energy is directly impeded, as, for example, in a piezoelectric lighter in which the piezoelectric device, activated by the second actuator, does not reach the position in which the spark is generated.

Finally another embodiment of the invention is attained when the combustible fluid only arrives at the ignition zone if said certain preset values of said relative position are reached. In fact, the lighters that have a state of ignition with a flame, said state of ignition can be avoided, avoiding that the combustion of the combustible fluid starts or by avoiding the release of the combustible fluid from the corresponding canister by which, although the ignition energy, for example the spark, is produced and is present at the ignition area, however, the lack of combustible fluid will avoid the flame from being produced.

Other advantages and characteristics of the invention may be appreciated from the following descriptions in which, without any limiting character, different embodiments of the invention are related, mentioning the enclosed drawings, in wich:

FIG. 1, a side elevational view of two lighters according to the invention, showing different relative positions of the two actuators.

Figure 2:
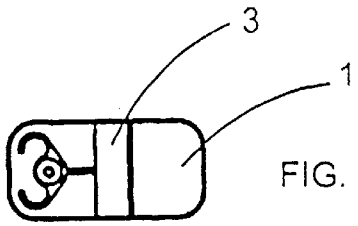

FIG. 2, a top view of the lighters in FIG. 1.

Figure 3:
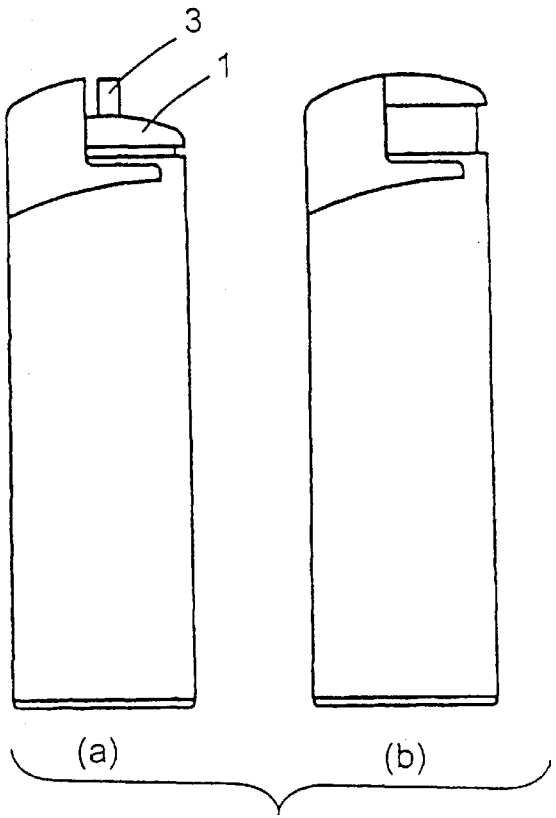

FIG. 3, a side elevational view of two other lighters according to the invention, showing different relative positions of the two actuators.

Figure 4:
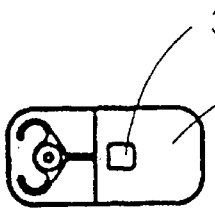

FIG. 4, a top view of the lighters in FIG. 3.

FIG. 5, a schematic view of the forces that are exerted on the actuators.

FIG. 6, a schematic view of the forces that are exerted on a finger at the time of lighting a lighter according to the invention.

FIG. 7, a view of a lighting sequence, showing different end positions of the actuators.

Figure 8:
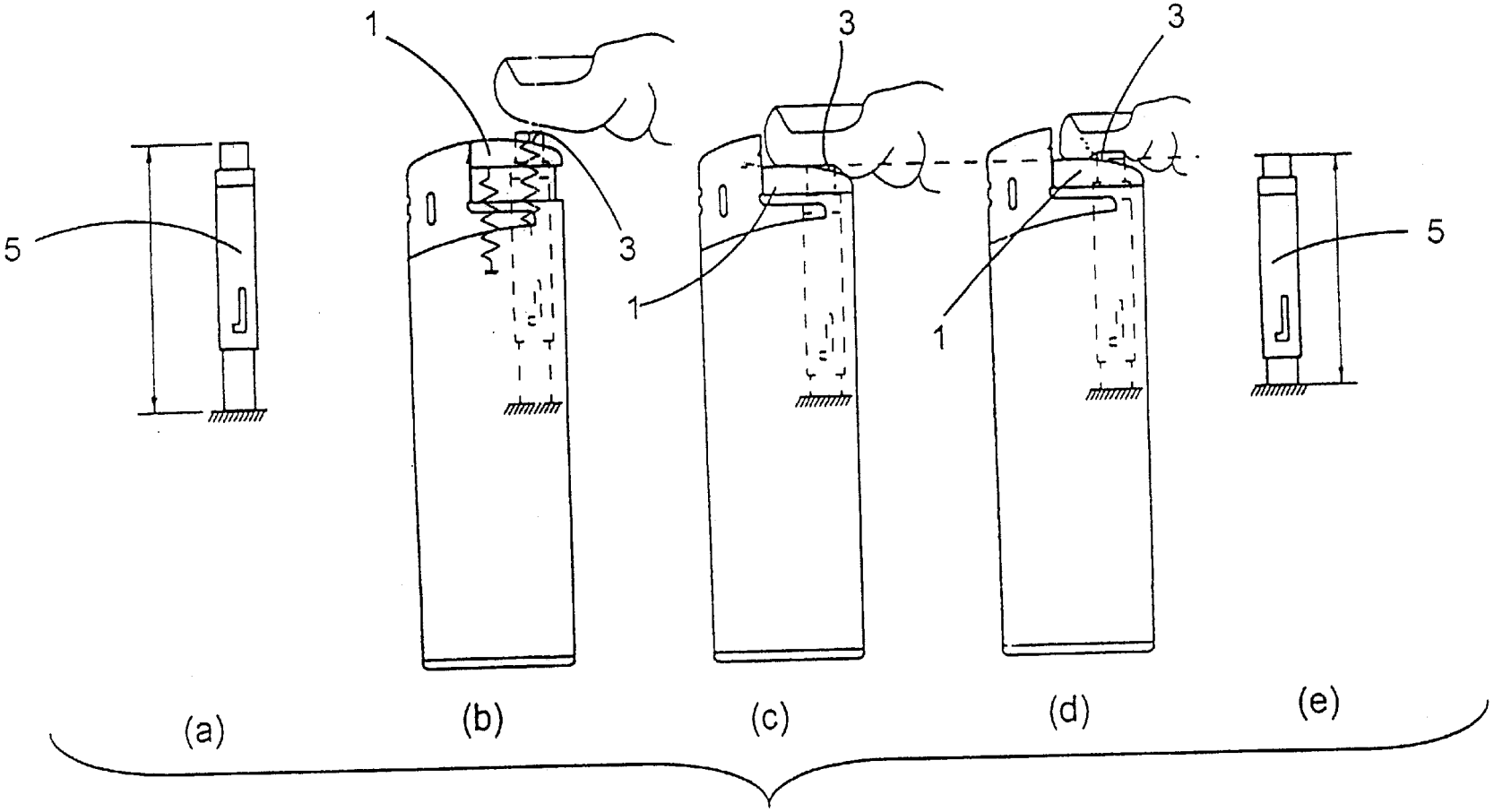

FIG. 8, a view of another lighting sequence, showing different end positions, in the case of a lighter with a piezoelectric device, that does not liberate the ignition energy if the second actuator does not reach a determined fourth position.

FIG. 9, a cross-sectional view of a lighter with a piezoelectric device according to the invention, which diverts the spark to an area away from the ignition zone.

Figure 10:
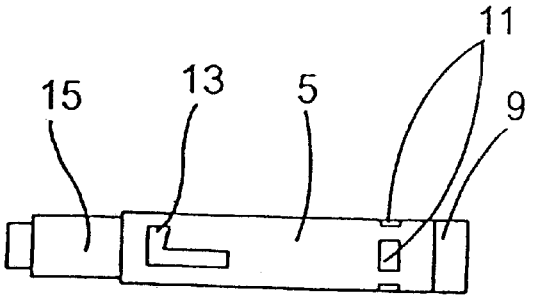

FIG. 10, a piezoelectric device in its extended position.

Figure 11:
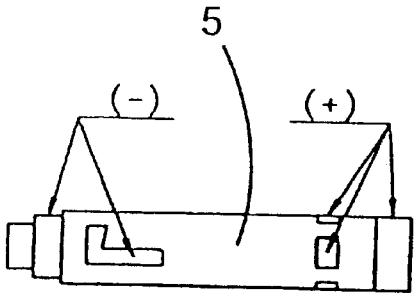

FIG. 11, a piezoelectric device in its compressed position.

FIG. 12, a croos-sectional view of the lighter in FIG. 9, with the two actuators in the ignition position.

FIG. 13, the view in FIG. 12, but with both actuators in a non-ignition position.

Figure 14:
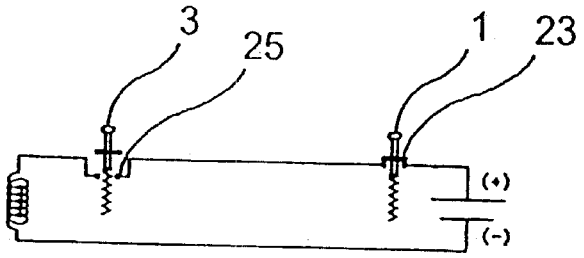

FIG. 14, an electrical drawing of a lighter according to the invention in which the second button is apt to avoid the formation of an electric current that heats a resistor.

Figure 15:
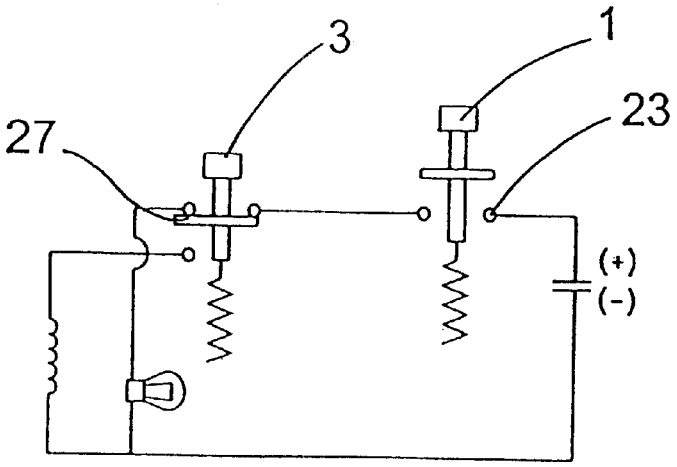

FIG. 15, an electrical drawing of a lighter according to the invention in which the second button is apt to divert an electric current, avoiding that it heats a resistor.

Figure 16:
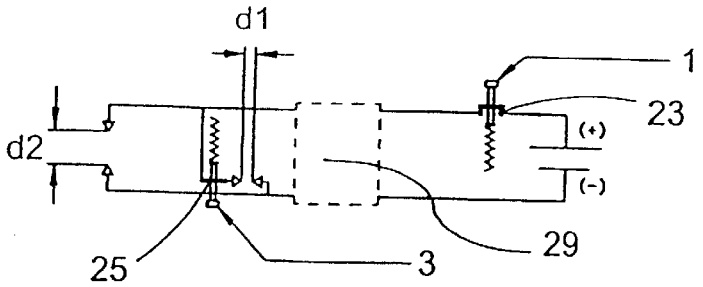

FIG. 16, an electrical drawing of a lighter according to the invention in which the second button is apt to divert a spark, avoiding that it is generated at the ignition zone.

Figure 17:
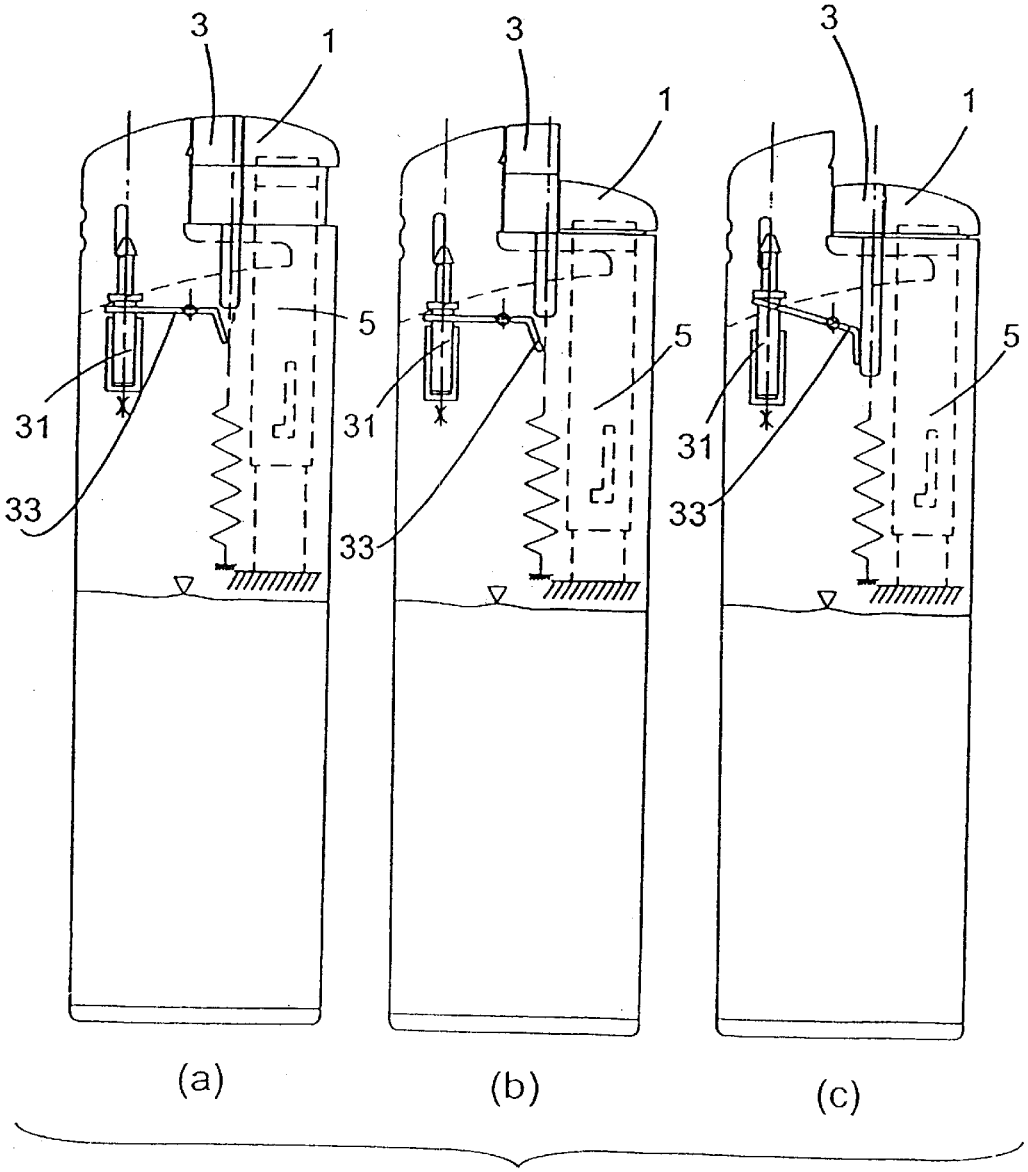

FIG. 17, a view of another lighting sequence showing different end positions in the case of a lighter that avoids the release of the combustible gas.

Figure 18:
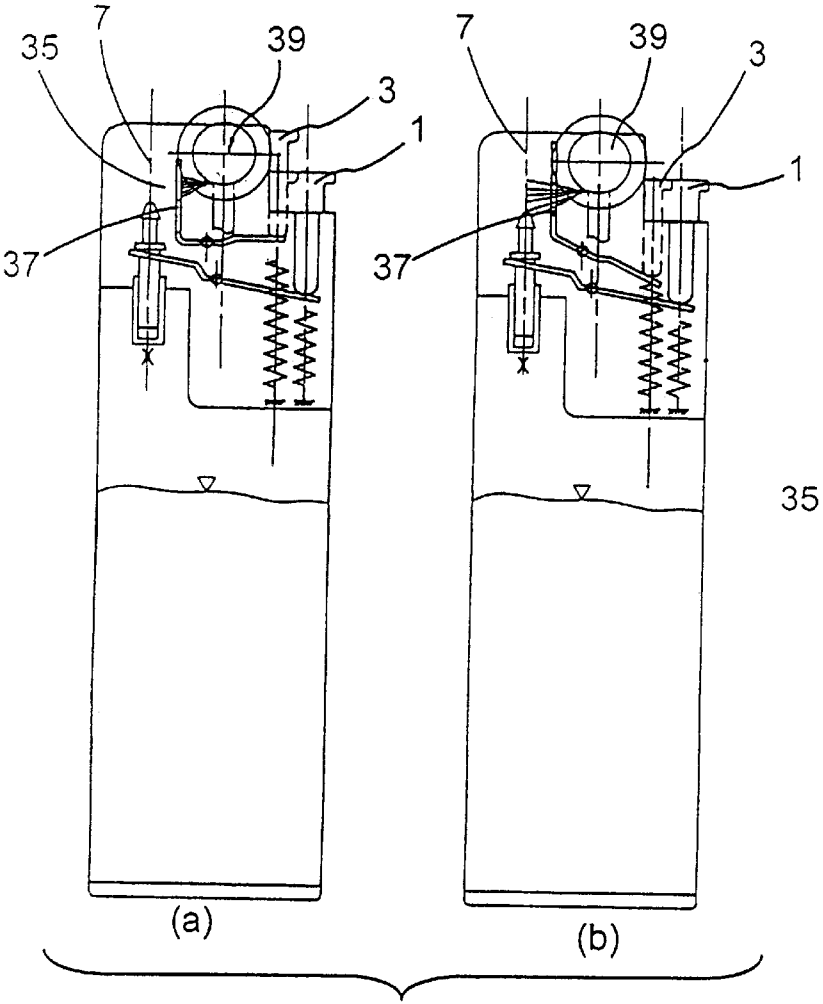

FIG. 18, a view of another lighting sequence showing different end positions in the case of a lighter with a pyrophoric stone and a shield.

Figure 19:
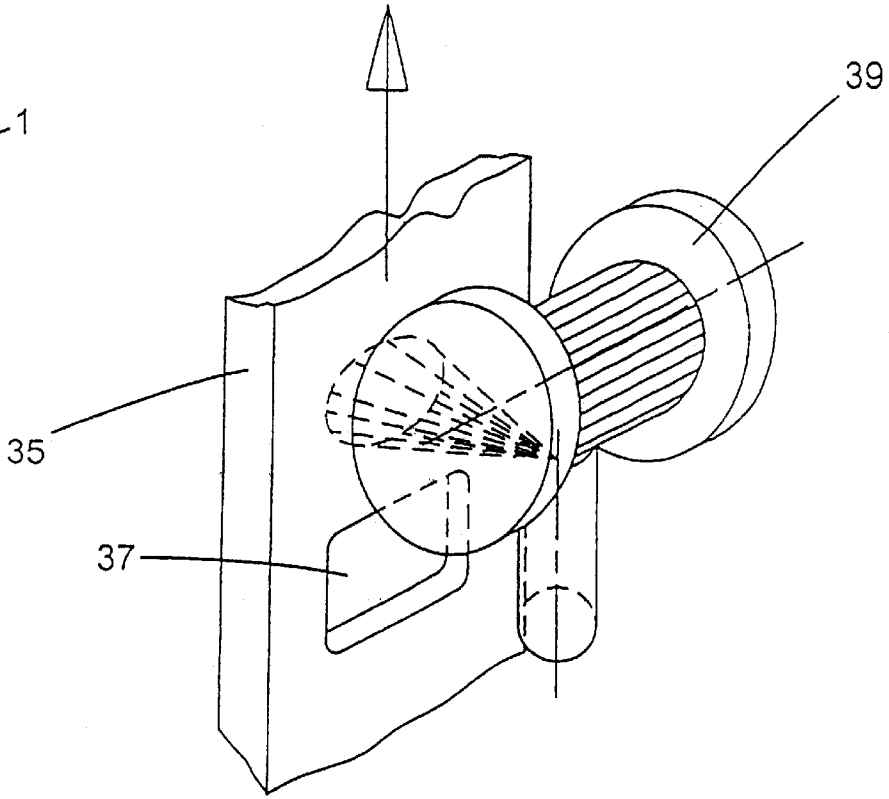

FIG. 19, a perspective view of the pyrophoric stone and the shield of FIG. 18.

In FIGS. 1 to 4 some examples can be seen of the embodiment of a lighter according to the invention. The lighter has a first actuator 1 and a second actuator 3, physically adjacent but that can be moved independently. The actuators 1 and 3 may present multiple different forms, and the movements may be diverse (translation, turn, translation and turn, etc.) without this affecting the invention. Likewise, with respect to what is mentioned hereafter, the functions of the first actuator 1 and the second actuator 3 can be exchanged in many cases, that is, the functions described for the first actuator 1 can be performed by the second actuator 3 and vice versa. It must be understood that all cases are likewise embodiments of the invention.

In FIGS. 1(*a*) and (*b*) and 3(*a*) and (*b*) it can be observed how the first actuator 1 can move between a first extended position and a second compressed position, while the second actuator 3 remains in a third extended position.

In practice, however, with both actuators 1 and 3 being physically together, when trying to light the lighter, the user's finger in one single movement simultaneously moves both actuators 1 and 3 from said first and third positions up to another second and fourth position, where the fourth position is the reached by the second actuator 3 in its compressed position.

Generally, each of the actuators 1 and 3 is submitted to a respective force F1 and F2, performed by the user's finger, and to forces proceeding from some springs encased inside the lighter's lighting mechanism (FIG. 5), which, when the second and fourth position have been reached, offset the forces F1 and F2 performed by the finger. Each one of the forces performed by the user's finger involves that in the user's finger an elastic deformation takes place that offsets said forces (FIG. 6). Each actuator 1 or 3, depending on the corresponding spring, exerts a different force on the finger, and therefore a different deformation. On the other hand, for a same force the deformation of the finger is different depending on the age of the user, as was previously indicated.

In FIG. 7 it can be observed how with fingers which present resistances to the different deformations, different relative positions may be obtained. In fact, in FIG. 7(*b*) the user's finger, which has taken the first actuator 1 to the second position and the second actuator 3 to the fourth position, has experienced some determined deformations, symbolically marked as shaded areas on the finger shown on top. However, for the same lighter, a finger that presents less resistance to deformation will move the second actuator 3 to a fourth position shown in FIG. 7(*c*). In fact, the lesser hardness requires a larger deformation on the finger, however, since the surface of the second actuator 3 is smaller than that of the first actuator 1, the first actuator 1 has already reached the limit of its course, while the second actuator 3 remains in a fourth more elevated position with respect to the first actuator 1, than in the case shown in FIG. 7(*b*). If the user tries to exert more strength, he does not substantially move the second actuator 3, as because, as the first actuator 1 at the limit of its course, it impedes practically any additional movement.

In a similar manner it can be observed in FIGS. 8 (*c*) and (*d*) how the different resistance to deformation of two fingers makes the relative position between the actuators 1 and 3, when they are respectively in the second position and the fourth position, to be different. Neither in this example can the finger in FIG. 8(*d*) with a reasonable strength, force the second actuator 3 to reach the position it has reached in FIG. 8(*c*).

These differences in the relative position between both actuators 1 and 3 is taken advantage of, by means of some adequate mechanisms, to avoid that the lighter reaches the state of ignition.

Thus, the lighter represented in FIG. 8 is lit by means of a piezoelectric device 5. The piezoelectric device 5, the dimensions of which in the extended position have been shown in FIG. 8(*a*), needs to be compressed to the size shown in FIG. 8(*e*) to generate the voltage drop required to produce the spark in the ignition zone 7. As can be observed, this circumstance only takes place in FIG. 8(*c*), while the user in FIG. 8 (*d*) is not able to light the lighter.

In FIG. 9, another lighter is shown with a piezoelectric device 5. In this case, the forming of the spark is not avoided, but rather the spark is caused to be formed in a place away from the ignition zone 7. The piezoelectric device 5, which can be observed with more detail in FIGS. 10 and 11, has a series of conducting zones. Particularly it has a top conducting zone 9, located at the top end of the piezoelectric device 5, some first intermediate conducting zones 11, next to the top conducting zone 9, some second intermediate conducting zones 13, next to the bottom end of the piezoelectric device 5, and a bottom conducting zone 15, at the bottom end of the piezoelectric device 5. When the piezoelectric device 5 is compressed, the top conducting zone 9 and the first intermediate conducting zones 11 are charged positively, while the second intermediate conducting zones 13 and the bottom conducting zone 15 are charged negatively, as shown in FIG. 11. The lighter has a first actuator 1 and a second actuator 3. The first actuator 1 leans on the piezoelectric device 5, while the second actuator 3 leans on a spring 17, made of a conductive material. Between the first actuator 1 and the piezoelectric device 5 there is a sheet 19 of conductive material, in contact with the top conducting zone 9, wich extends to the edge of the ignition zone 7. At the ignition zone 7 is where the lighter's burner 21 is found, which is also made of conductive material. The bottom conducting zone 15 and/or the second intermediate conducting zones 13 are connected electrically to the spring 17 and the burner 21, by means of a tilting element 22 which on one side is fixed to the burner 21 and on the other it has some stems (not shown in the figures) that are in permanent contact with the spring 17. When both actuators 1 and 3 are pushed downwards in such a way that they are close together, the voltage drop generated by the piezoelectric device 5 is transmitted, on one hand, to the end of the sheet 19 that is at the edge of the ignition zone 7, and on the other hand to the burner 21. When not finding an "easier" way the current passes through the sheet 19 to the burner 21, forming a spark which causes the ignition of the flammable gas. If, to the contrary, the second actuator 3 does not reach a fourth position that is sufficiently low enough, then the spring 17 remains closer to the first intermediate conducting zones 11 (distance d1) than the distance that exists between sheet 19 and the burner 21 (distance d2). In this case, the spark does find an "easier" way and it will be formed between one of the said first intermediate conducting zones 11 and the spring 17 and, therefore, far from the ignition zone 7.

Additionally, it is observed that in the previous case the second position is always substantially the same, with the exception of possible variations for construction purposes which are not related to the invention, and the only one that varies is the fourth position, and therefore variations in the relative position are due to variations in the fourth position. However, what really allows the spark to form in the ignition zone 7 is the relative position between both actuators 1 and 3, which are the ones that define the distance d1 and thus it is possible to design a lighter according to the invention in which the second position is likewise variable.

FIG. 14 shows an electrical drawing corresponding to another particular embodiment of the invention. In this case the lighter has an electric battery and an electric resistor. In the event that the lighter reaches the state of ignition, an electric current is generated which heats the electric resistor. This electric resistor can also be used, likewise, to obtain the ignition of a flammable gas or it can be the element directly destined to light, for example, a cigarette. In any of these cases, the invention contemplates that the first actuator 1 closes a first switch 23, while the second actuator 3 closes a second switch 25, only if it reaches certain values of said relative position. In this way the electric circuit is positively closed and the electric current able to heat the electric resistor is created. There is an embodiment for this solution, which corresponds with the electric circuit represented in FIG. 15. In this case the electric current is generated for any relative position, but only for determined values of said relative position is it attained that a switch 27 makes the current reach the electric resistor. For any other value of the relative position the electric current is diverted and consumed in any other adequate element, represented symbolically in FIG. 15 as a light bulb, so that the state of ignition is not reached.

FIG. 16 shows an electric drawing of another embodiment of the invention. In this case the lighter reaches the state of ignition when a spark is generated in the ignition zone 7, where the voltage drop necessary to generate said spark is created by the electronic circuit 29, of a well known type, which is fed by a battery. The first actuator 1 closes a first switch 23 in such a way that it connects the battery with the electronic circuit 29, while the second actuator 3 diverts the spark to a place away from the ignition zone 7, except in those cases when the relative position reaches determined values. This diversion can be attained by means of a second switch 25, which allows the transmission of the voltage drop to the ignition zone 7 only for said determined values of the relative position, or by means of a physical proximity mechanism similar to that described in FIGS. 9 to 13.

For lighters in which the state of ignition is due to the combustion of a combustible fluid, said state of ignition can be avoided by impeding that the initiating effect of the combustion takes place (spark, incandescent resistor, etc.) or by impeding that the combustible fluid reaches the ignition zone 7 at the time when the initiating effect takes place. This can be attained, for example, by diverting the flow of combustible fluid to a place away from the ignition zone 7, or, preferably, avoiding that the combustible fluid leaves the containing canister. This is the case of the lighter shown in FIG. 17. There it can be observed that a valve 31 is opened, only for certain values of the relative position by means of a lever 33 which, in turn is activated by the second actuator 3.

Finally FIGS. 18 and 19 show another way of avoiding the state of ignition, in the case of lighters with pyrophoric stones. The second actuator 3 is responsible for the movement of shield 35 which has an opening 37. The shield 35 avoids that the spark generated by means of a pyrophoric stone reaches the ignition zone 7. Only if the second actuator 3 reaches said determined values for the relative position does the opening 37 align with the pathway that the spark must follow to reach the ignition zone 7, and therefore, only in these cases is it attained that the spark starts the combustion of the combustible fluid. It is observed in this case that in fact there are three actuators (the third actuator is the wheel 39), but it is still necessary that in order tu reach the state of ignition, two of them (the first and the second actuators 1 and 3) reach a determined relative position which is variable according to the resistance to deformation of the finger.

In the previous examples it is observed that generally, both actuators 1 and 3 actively participate in the lighter's lighting mechanism, for example one actuator is responsible for generating the spark and the other is responsible for opening the valve of the flammable fluid, or an actuator is responsible for diverting the spark, etc. However, the object of the invention does not necessarily require that both actuators participate in such an "active" way in the lighting mechanism. Thus, for example, it may be supposed that in the lighter of FIG. 8 the second actuator 3 is responsible for all of the functions for ignition (opening the valve and generating the spark if the relative position is correct) while the first actuator 1 does not "do anything." Really, in this case, the function of the first actuator 1 consists only in causing force F1 and the corresponding deformation of the user's finger, and thus that the force F2 and the corresponding deformation of the user's finger is translated to a relative position between both actuators which is variable depending on the hardness of the user's finger. In this case, while the first actuator 1 may simply be a button with a spring under it, it must be considered as forming part of the lighting mechanism, since to move the second actuator 3 with the finger the first actuator 1 must necessarily be moved. A lighter with these characteristics thoroughly complies with the object of the invention. Likewise, a lighter may be designed similar to that of FIG. 17, but in which the second actuator 3 is responsible both for opening the valve 31 as for activation the piezoelectric device 5, while the first actuator 1 only rests on a spring. It is also possible to design a lighter that has a battery, similar to those corresponding to FIGS. 14 to 16, in which the lighting mechanism is completely conventional, and therefore with only one switch that is activated by means of the second actuator 3, with the exception that it additionally has a first actuator 1 which allows the forming of said relative position.

Finally it is even possible to develop a lighter that has a first actuator 1 and a second actuator 3, for example like those in FIGS. 3 and 4, where all of the ignition functions are activated by the second actuator 3, while the first actuator 1 permanently remains in its second position (that corresponding to FIG. 3(*a*)). In this case, when wanting to light the lighter, the finger starts exerting a force F2 on the second actuator 3, moving it downwards. When reaching a position near to the bottom, that is, the fourth position, the finger makes contact with the first actuator 1, thus generating force F1 (in this case the movement of the first actuator would be limited to the small movement due to the elastic deformation of the first actuator 1) and the corresponding deformation of the finger. The course of the finger is thus limited by the first actuator 1 and if the relative position between both actuators 1 and 3, in their respective second and fourth positions, is not the appropriate one, the lighter does not light. This embodiment may be used in the majority of conventional lighters, being sufficient to conveniently reduce the size of the existing actuator and placing around it a fixed part, in an adequate position to attain that the finger rests on this fixed part when wanting to light the lighter, so that force F1 is generated, with the corresponding deformation of the finger, and therefore of the second actuator 3.

What is claimed is:

1. A portable lighter, suitable for reaching a state of ignition, comprising a lighting mechanism activatable by a single movement of an operator's finger, where said finger presents a resistance to deformation, said mechanism including at least a first actuator and a second actuator, said first actuator being movable between a first position and a second position, and said second actuator being movable between a third position and a fourth position, said second position and said fourth position defining a relative position between said first actuator and said second actuator, said actuators being arranged so that when said first actuator is moved by the single finger movement from said first position to said second position the finger simultaneously moves said second actuator from said third position to said finger position, said relative position being variable according to the finger's resistance to deformation, said portable lighter reaching said state of ignition only for certain preset values of said relative position.

2. The lighter according to claim 1, wherein said fourth position is variable depending on the resistance of deformation of the finger while said second position is substantially independent from the resistance to deformation so that said relative position is variable depending on said fourth position.

3. The lighter according to claim 1, and further comprising a piezoelectric mechanism for generating an ignition energy that arrives to an ignition zone to reach said state of ignition, said first actuator being arranged to act upon said piezoelectric mechanism to generate said ignition energy, said second actuator being arranged to allow said ignition energy to reach said ignition zone within said certain preset values of said relative position.

4. The lighter according to claim 3, wherein said second actuator is operative to divert a spark of said piezoelectric element to an inert zone away from said ignition zone when said relative position is not at one of said preset values.

5. The lighter according to claim 1 and further comprising a pyrophoric stone that creates a spark to an ignition zone to ignite a combustible fluid, and a shield operatively connected to the second actuator so that when said relative position is not at one of the said preset values said second actuator inserts the shield between said spark and said ignition zone.

6. The lighter according to claim 1, and further comprising an electric battery that outputs an electric current that generates a spark to an ignition zone to ignite a conbustible fluid, the first actuator being arranged to act on the battery to generate the spark, said second actuator being arranged to divert said electric current to avoid formation of said spark when said relative position is not at one of the said preset values.

7. The lighter according to claim 1, and further comprising an electric resistor and an electric battery that outputs current that heats the resistor to provide an ignition energy to an ignition zone, the first actuator being arranged to act on the battery to release current to the resistor, said second actuator being arranged to divert said electric current to avoid heating said electric resistor when said relative position is not at one of the said preset values.

8. The lighter according to claim 1, and further comprising an electric resistor and an electric battery that outputs electric current that heats the resistor to provide an ignition energy to an ignition zone, the first actuator being arranged to act on the battery to release current to the resistor, said second actuator being arranged to inhibit said electric current to avoid heating said electric resistor when said relative position is not at one of the said preset values.

9. The lighter according to claim 3, wherein the ignition energy ignites a combustible fluid, said combustible fluid only arriving at said ignition zone if said certain preset values of said relative position are reached.

* * * * *